US009786465B2

(12) United States Patent
Li et al.

(10) Patent No.: US 9,786,465 B2
(45) Date of Patent: Oct. 10, 2017

(54) APPARATUSES AND METHODS FOR GENERATING DISTRIBUTED X-RAYS

(71) Applicants: TSINGHUA UNIVERSITY, Tsinghua Yuan, Haidian District, Beijing (CN); NUCTECH COMPANY LIMITED, Shangqinglu, Haidian District, Beijing (CN)

(72) Inventors: Yuanjing Li, Beijing (CN); Yaohong Liu, Beijing (CN); Jinsheng Liu, Beijing (CN); Huaping Tang, Beijing (CN); Chuanxiang Tang, Beijing (CN); Huaibi Chen, Beijing (CN); Xinshui Yan, Beijing (CN)

(73) Assignees: TSINGHUA UNIVERSITY, Beijing (CN); NUCTECH COMPANY LIMITED, Beijing (CN)

( * ) Notice: Subject to any disclaimer, the term of this patent is extended or adjusted under 35 U.S.C. 154(b) by 379 days.

(21) Appl. No.: 14/136,362

(22) Filed: Dec. 20, 2013

(65) Prior Publication Data

US 2014/0185776 A1 Jul. 3, 2014

(30) Foreign Application Priority Data

Dec. 27, 2012 (CN) ..... 2012 1 0581566

(51) Int. Cl.
*H01J 35/14* (2006.01)
*H01J 35/30* (2006.01)

(52) U.S. Cl.
CPC ..... *H01J 35/14* (2013.01); *H01J 35/30* (2013.01); *H01J 2235/16* (2013.01)

(58) Field of Classification Search
CPC ..... H01J 35/14; H01J 35/30; H01J 35/045; H01J 2235/16
See application file for complete search history.

(56) References Cited

U.S. PATENT DOCUMENTS 4,002,917 A 1/1977 Mayo
4,024,424 A * 5/1977 Eggelsmann ..... H01J 35/101 378/131

(Continued)

FOREIGN PATENT DOCUMENTS

CN 101110280 1/2008
CN 102370494 3/2012

(Continued)

OTHER PUBLICATIONS

Search and Examination Report issued for Great Britain Patent Application No. 1322299.7, dated Jun. 30, 2014.

(Continued)

*Primary Examiner* — Glen Kao
(74) *Attorney, Agent, or Firm* — Pillsbury Winthrop Shaw Piltman LLP

(57) ABSTRACT

An apparatus and method to generate distributed x-rays. A hot cathode of an electron gun is used in vacuum to generate electron beams having certain initial movement energy and speed. Periodic scanning is performed with the initial low-energy electron beams, which are thus caused to be reciprocally deflected. A current-limiting device is provided in the travel path of the electron beams along the direction of the reciprocal deflection. Through holes arranged in an array on the current-limiting device, only part of the electron beams targeting specific positions can pass to form sequential electron beam currents distributed in an array. These electron beam currents are accelerated by a high-voltage electric field to obtain high energy, bombard an anode target, and thus sequentially generate corresponding focus spots and x-rays distributed in an array at the anode target.

20 Claims, 5 Drawing Sheets

(56) References Cited

U.S. PATENT DOCUMENTS

| | | | | |
|---|---|---|---|---|
| 4,426,722 | A | 1/1984 | Fujimura | |
| 4,926,452 | A | 5/1990 | Baker | |
| 5,576,549 | A | 11/1996 | Hell | |
| 5,596,621 | A * | 1/1997 | Schwarz | H01J 35/00 378/130 |
| 6,421,420 | B1 | 7/2002 | Grodzins | |
| 7,856,086 | B2 | 12/2010 | Tanabe | |
| 2004/0119021 | A1 | 6/2004 | Parker | |
| 2004/0208280 | A1 * | 10/2004 | Yada | G01N 23/04 378/43 |
| 2009/0154650 | A1 | 6/2009 | Tanabe | |
| 2009/0225953 | A1 * | 9/2009 | Danzer | A61B 6/06 378/147 |
| 2010/0254507 | A1 | 10/2010 | Hampel | |
| 2010/0260317 | A1 * | 10/2010 | Chang | A61N 5/103 378/62 |
| 2012/0027173 | A1 | 2/2012 | Duerr | |
| 2012/0057669 | A1 * | 3/2012 | Vogtmeier | H01J 35/06 378/4 |
| 2012/0294424 | A1 * | 11/2012 | Chin | A61N 5/1042 378/65 |
| 2013/0287176 | A1 * | 10/2013 | Rommel | H01J 35/10 378/125 |

FOREIGN PATENT DOCUMENTS

| | | | |
|---|---|---|---|
| CN | 102422364 | | 4/2012 |
| CN | 203083952 | | 7/2013 |
| CN | 203192747 | | 9/2013 |
| DE | 102011076072 | | 11/2012 |
| EP | 2 238 908 | | 10/2010 |
| JP | S51-054793 | | 5/1976 |
| JP | S59-094349 | A | 5/1984 |
| JP | 2003-344596 | | 12/2003 |
| JP | 2005-321282 | | 11/2005 |
| JP | 2006-024522 | | 1/2006 |
| JP | 2009-142444 | A | 7/2009 |
| JP | 2012-522332 | A | 9/2012 |
| WO | WO 2006/116365 | | 11/2006 |
| WO | WO 2006/130630 | | 12/2006 |
| WO | WO 2011/119629 | | 9/2011 |

OTHER PUBLICATIONS

Search Report and Written Opinion issued for International Application No. PCT/CN2013/087608, dated Feb. 27, 2014.

Extended Search Report, including the Search Opinion, issued for European Patent Application No. 13198330.6, dated Mar. 5, 2014.

Office Action as issued for Japanese Patent Application No. 2013-262369, dated Dec. 1, 2014.

Australian Office Action dated Apr. 22, 2016 in corresponding Australian Patent Application No. 2013370034.

Russian Office Action dated Nov. 21, 2016 in corresponding Russian Patent Application No. 2015131158.

Chinese Office Action dated Dec. 27, 2016 in corresponding Chinese Patent Application No. 201210581566.9.

Second Office Action as issued in Chinese Patent Application No. 201210581566.9, dated Jul. 21, 2016.

Third Office Action as issued in Chinese Patent Application No. 201210581566.9, dated Dec. 27, 2016.

Office Action as issued in Russian Patent Application No. 2015131158, dated Mar. 31, 2017.

* cited by examiner

APPARATUSES AND METHODS FOR GENERATING DISTRIBUTED X-RAYS

This application claims priority from Chinese Patent Application No. 201210581566.9, filed Dec. 27, 2012, which is incorporated herein in its entirety by reference.

TECHNICAL FIELD

The present disclosure relates to generating x-rays in a distributed manner, and in particular to apparatuses and methods to generate distributed x-rays.

BACKGROUND

X-ray sources refer to apparatuses for generating x-rays, and generally include a x-ray tube, power & control system, and auxiliary devices such as cooling and shielding devices. The core device is the x-ray tube which is generally formed of a cathode, an anode, and a glass or ceramic case. The cathode may be made of a directly-heated spiral tungsten filament. In operation, a current flows through the cathode, and the cathode is heated to an operation temperature of about 2000K, and generates thermally-emitted electron beam currents. The cathode is surrounded by a metal hood in which a groove is opened at the front end. The metal hood enables the electrons to be focused. The anode may be made of a tungsten target mosaicked in an end surface of copper plate. There is a high voltage of hundreds of thousands volts between the anode and the cathode in operation. The electrons generated at the cathode are accelerated and travel to the anode under the electric field, and bombard the surface of the target, thereby generating x-rays.

X-rays are widely used in various fields including industrial non-destructive inspection, safety inspection, medical diagnosis, and treatment. In particular, x-ray perspective imaging apparatuses utilizing the high penetrating ability of x-rays play an important role in various aspects of people's daily life. In the past such apparatuses include film-type plane perspective imaging apparatuses. Current advanced apparatuses include digitalized, multi-view, high-resolution stereo imaging apparatuses, such as CT (Computed Tomography) which can obtain high-resolution 3-dimensional graphics or slice images, and have become an advanced and sophisticated application.

In many CT apparatuses (including CTs for industrial flaw detection, luggage or article safety inspection, medical diagnosis, and the like), an x-ray source is generally placed at one side of a subject article, and detectors are placed at the other side of the subject article for receiving the rays. When penetrating the subject article, the intensity of the x-rays will change with the thickness, density and the like of the subject article. The intensity of the x-rays received by the detectors implies information about the composition of the subject article from a certain view angle. If the locations of the x-ray source and the detector are changed around the subject article, composition information can be obtained from different view angles. The perspective image of the subject article can be obtained by performing reconstruction based on the obtained information through computer systems and software algorithms. In the existing CT apparatuses, the x-ray source and the detector are positioned on a circular slip ring surrounding the subject. In operation, an image for one section along the thickness of the subject is obtained for each loop the x-ray source and the detector move along the circular slip ring. Such an image is called a slice. Then, the subject article is moved along the thickness direction to obtain a sequence of slices. These slices are combined to show a fine 3D structure of the subject article.

SUMMARY

Accordingly, in the existing CT apparatuses, in order to obtain image information at different view angles, it is necessary to change the location of the x-ray source. The x-ray source and the detector often move along the slip ring at a very high speed to accelerate the inspection. The overall reliability and stability of the apparatus are reduced due to the high-speed movement of the x-ray source and the detector along the slip ring. Meanwhile, the inspection speed of the CT apparatus is limited by the movement speed. In recent years, the latest generation of CT apparatus utilizes detectors arranged in a circle, and thus the detectors do not need to move. However, the x-ray source still has to move along the slip ring. The CT inspection speed can be improved by placing multiple rows of detectors and thus obtaining multiple slice images for each loop the x-ray source moves. However, this cannot eliminate the problem caused by the movement along the slip ring. There is thus a need for an x-ray source in the CT apparatus so that multiple images at different view angles can be obtained without changing the location of the x-ray source.

To increase the inspection speed, electron beams generated at the cathode of the x-ray source are generally used to bombard the tungsten target at the anode at a high power for a long time. The target points are very small in size, and thus heat dissipation becomes a problem with the target points.

Some patents and documents propose certain methods to address the problems with the current CT apparatuses, such as reliability, stability, inspection speed, and heat dissipation of the anode target points. For example, over-heating of the anode target may be mitigated to some extent by rotating the target in the x-ray source. However, such a method is implemented with a complicated structure, and target points generating x-rays still remain at fixed positions with respect to the x-ray source as a whole. As another example, a method for obtaining multiple view angles with a stationary x-ray source is to closely arrange multiple individual conventional x-ray sources along the circumference of a circle, instead of moving the x-ray source. Although this method can obtain multiple view angles, it requires a high cost, and obtains low-quality (stereo resolution) images due to large intervals between target points at different viewpoints. U.S. Pat. No. 4,926,452 describes a method for generating distributed X rays in an X-ray source. In the method, the anode target has a large area, and this mitigates the problem of target overheating. Further, the positions of target points change along a circumference, and thus multiple view angles can be obtained. The method in U.S. Pat. No. 4,926,452 is an effective way to generate a distributed X-rays, though it is used to scan and deflect accelerated high-energy electron beams, and has problems such as difficulties in control operation, non-discrete positions of target points, and bad repetitiveness.

PCT Patent Application Publication No. WO 2011/119629 describes a method for generating distributed x-rays in an X-ray source. In the method, the anode target has a large area, and this mitigates the problem of target overheating. Further, the positions of target points are separated and fixedly arranged in an array, and thus multiple view angles can be obtained. Carbon nano tubes are arranged in an array to form cold cathodes. Voltages between cathode gates are used to control field emission, thereby controlling the cathodes to emit electrons sequentially. Then the emitted electrons bombard the anode target at corresponding positions, and thus the source becomes a distributed x-ray source. However, the method has disadvantages including complex manufacture processes, low emission power and short life time of the carbon nano tubes.

Apparatuses and methods to generate distributed x-rays are provided in view of, for example, one or more of the problems with the conventional technology.

In an aspect of the present disclosure, an apparatus for generating distributed x-rays is provided including: an electron gun configured to generate electron beam currents; a scanning device arranged to surround the electron beam currents and configured to generate a scanning magnetic field to deflect the electron beam currents; a current-limiting device having a plurality of regularly-arranged holes, wherein when the electron beam currents scan through the current-limiting device under the control of the scanning device, pulsed electron beams corresponding to positions of the holes in the scanning order are outputted successively in an array beneath the current-limiting device; and an anode target arranged downstream of the current-limiting device, wherein by applying a voltage to the anode target, a uniform electric field is formed between the current-limiting device and the anode target to accelerate the array of the pulsed electron beams, and wherein x-rays are generated when the accelerated electron beams bombard the anode target.

In another aspect of the present disclosure, a method of generating distributed x-rays is provided including: controlling an electron gun to generate electron beam currents; controlling a scanning device to generate a scanning magnetic field to deflect the electron beam currents, the electron beam currents scanning through a plurality of holes regularly arranged on a current-limiting device under the control of the scanning device to sequentially output pulsed electron beams distributed in an array; and generating an electric field to accelerate the pulsed electron beams distributed in the array, the accelerated electron beams bombarding the anode target to generate x-rays.

According to the above aspects of the present disclosure, positions of beam currents and focus spots can be changed by means of electromagnetic scanning in a fast and efficient manner. The design of conducting current limitation before high-energy acceleration can obtain beam currents distribution in an array, preserve electric power and effectively prevent the current-limiting device from generating heat.

Further, according to some embodiments of the present disclosure, using a hot-cathode source has an advantage of high emission current and long life time compared with other designs.

Further, scanning directly with electron beam currents at low energy of initial movement has an advantage of easier control and higher scanning speed.

Further, the design of a large strip-shaped anode can effectively mitigate overheating of the anode, and facilitate improvement of source power.

Further, compared with other distributed x-ray source apparatuses, the above embodiments have an advantage of high current, small target points, uniform distribution of positions of the target points, good repetitiveness, high output power, simple process and low cost.

Further, the apparatus to generate distributed x-rays according to the embodiments of the present disclosure can be applied in CT apparatuses to obtain multiple view angles without movement of the source, and thus omit the movement along the slip ring. This is advantageous for structure simplification, and improvement of system stability, reliability and inspection efficiency.

BRIEF DESCRIPTION OF THE DRAWINGS

The following figures illustrate implementations of the present disclosure. The figures and implementations provide some embodiments of the present disclosure in a non-limiting and non-exclusive manner, in which.

DETAILED DESCRIPTION OF THE EMBODIMENTS

Figure 1:
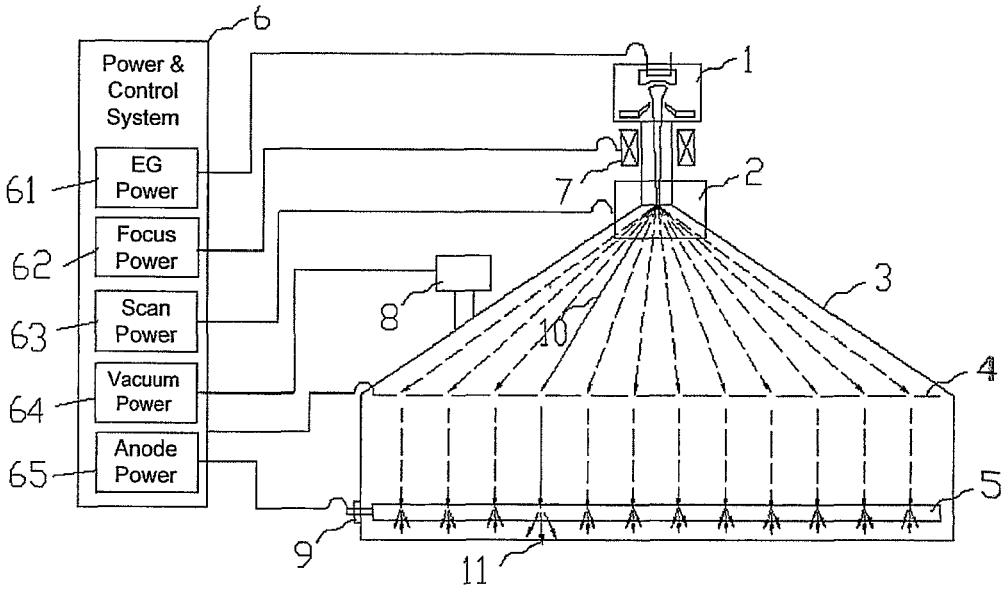
FIG. 1 is a schematic diagram of an apparatus to generate distributed x-rays according to an embodiment of the present disclosure.

In the following, particular embodiments of the present disclosure will be detailed. To be noted, the described embodiments are just intended for illustrating other than limiting the present disclosure. Numerous specific details are illustrated for a clear and thorough understanding of the present disclosure. It is apparent to those skilled in the art that these specific details are not necessary for implementation of the present disclosure. Detailed description of known circuits, materials or methods are omitted which otherwise may obscure the present disclosure.

Throughout the specification, reference to "an embodiment," "embodiments," "an example" or "examples" means that particular features, structures or characteristics described in connection with such embodiment or example are contained in at least one embodiment of the present disclosure. The phrase "an embodiment," "embodiments," "an example" or "examples" in various places throughout the specification does not necessarily refer to the same embodiment or example. Further, the particular features, structures or characteristics may be contained in one or more embodiments or examples in any appropriate combination and/or sub-combination. Those skilled in the art will appreciate that the term "and/or" herein indicates any or all combinations of one or more of the listed items.

Embodiments of the present disclosure provide apparatuses and methods to generate distributed x-rays in view of one or more of problems with the conventional technology. For example, a hot cathode of an electron gun is used in vacuum to generate electron beams having certain initial movement energy and speed. Then, periodic scanning is performed with the initial low-energy electron beams, which are thus caused to be reciprocally deflected. A current-limiting device is provided in the travel path of the electron beams along the direction of the reciprocal deflection. Through holes arranged in an array on the current-limiting device, only part of the electron beams targeting specific positions can pass to form sequential electron beam currents distributed in an array. Next, these electron beam currents are accelerated by a high-voltage electric field to obtain high energy, bombard the anode target, and thus sequentially generate corresponding focus spots and x-rays distributed in an array at the anode target. According to embodiments of the present disclosure, positions of beam currents and focus spots can be changed by means of electromagnetic scanning in a fast and efficient manner. The design of conducting current limitation before high-energy acceleration can obtain beam currents distribution in an array, preserve electric power and effectively prevent the current-limiting device from generating heat.

As an example, an apparatus to generate distributed x-rays according to an embodiment includes an electron gun, a scanning device, a vacuum box, a current-limiting device, an anode target, a power and control system and the like. The electron gun is coupled to the top of the vacuum box, and generates electron beam currents having initial movement energy and speed which enter the vacuum box. The scanning device mounted outside the top of the vacuum box generates periodic magnetic fields which cause periodic deflection of the electron beam currents. After traveling for a distance, the electron beam currents arrive at the current-limiting device disposed at a central part of the vacuum box. An array of holes on the current-limiting device permit only part of the electron beams at appropriate positions to pass through, thereby forming sequential, array-distributed electron beam currents beneath the current-limiting device. A high voltage is applied to the anode target disposed at the bottom of the vacuum box, and thus an electric field for acceleration is formed between the current-limiting device and the anode target. The sequential, array-distributed electron beam currents passing through the current-limiting device are accelerated by the electric field, obtain high energy and bombard the anode target. Therefore, corresponding array-distributed x-ray focus spots and x-rays are sequentially generated at the anode target. The power and control system supplies operation currents and the high voltage to the respective electron gun, the scanning device, the anode target and the like, provides man-machine operation interface and logic management, and flow control for normal operation of the overall apparatus.

FIG. 1 is a schematic diagram of an apparatus to generate distributed x-rays according to an embodiment of the present disclosure. The apparatus to generate distributed x-rays as shown in FIG. 1 includes electron gun 1, scanning device 2, vacuum box 3, current-limiting device 4, anode target 5, and power and control system 6. The electron gun 1 is coupled to the top of the vacuum box 3, the scanning device 2 is mounted outside the top of the vacuum box 3, and the current-limiting device 4 is disposed at a central part of the vacuum box 3. In an example, the current-limiting device has a plurality of holes regularly arranged. The anode target 5 is of a strip shape, for example, and mounted at the lower side of the vacuum box 3. The anode target 5 is parallel to the current-limiting device 4, and they have the substantially same length. In another embodiment, the strip-shaped anode target 5 may have a length different from that of the plate-shaped current-limiting device 4. For example, the anode target 5 may be longer and/or wider than the current-limiting device 4. The side of the strip-shaped anode target 5 opposite to the current-limiting device 4 may be a planar side in the shape of a strip. The rear side of the anode target 5 may be a non-planar structure of any other shape, such as a radiating fin structure or reinforcing rib structure. This can provide greater strength, larger thermal capacity, and better heat dissipation.

According to an embodiment of the present disclosure, the electron gun 1 is configured to generate electron beam currents 10 having initial movement speed and energy. The electron gun may be structured to, for example, include a cathode to emit electrons, a focusing electrode to limit the electron beam currents so as to achieve small-sized beam current spots and good consistency in travel pattern, and an anode to accelerate and lead out electrons. According to a particular embodiment of the present disclosure, the electron gun 1 is a hot cathode electron gun having high power for emitting electron beam currents, and long life time. The cathode of the hot cathode electron gun is usually heated with a filament to 1000~2000° C., and emits currents at a density up to several $As/cm^2$. In general, the anode of the electron gun is grounded, and the cathode is set at a negative high voltage. The high voltage at the cathode is usually between negative several kVs to negative tens of kVs.

Figure 2:
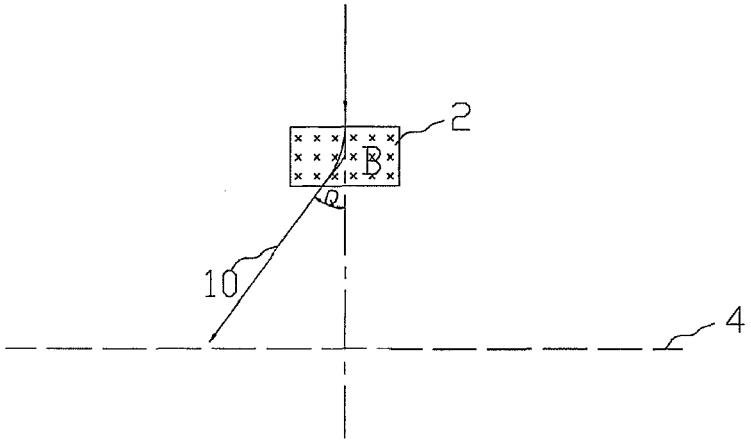
FIG. 2 is a schematic diagram depicting the movement direction of electron beam currents deflected by a magnetic field in the apparatus according to an embodiment of the present disclosure.

According to an embodiment of the present disclosure, the scanning device 2 may include a coreless scanning coil pack or core-type scanning magnet. The primary function of the scanning device 2 is, when being driven by scanning currents, to generate a scanning magnetic field which deflects the travel direction of the electron beam currents 10 passing through the scanning device 2. FIG. 2 is a schematic diagram showing the travel direction of the electron beam currents 10 is deflected under the magnetic field. As the strength of the magnetic field B increases, the angle θ at which the travel direction of the electron beam currents 10 is deflected becomes larger, and thus the offset L from the center of the current-limiting device 4 increases when the electron beam currents 10 arrive at the current-limiting device 4. The correspondence between L and B is L=L(B), that is, the offset L of the electron beam currents from the center of the current-limiting device 4 can be controlled by controlling the magnitude of the magnetic field B, which is determined by the magnitude of the scanning current Is, i.e., B=B(Is). This is usually a direct proportion. In this way, it is possible to control the offset L of the electron beam currents 10 from the center of the current-limiting device 4 by controlling the magnitude of the scanning current Is.

Figure 3:
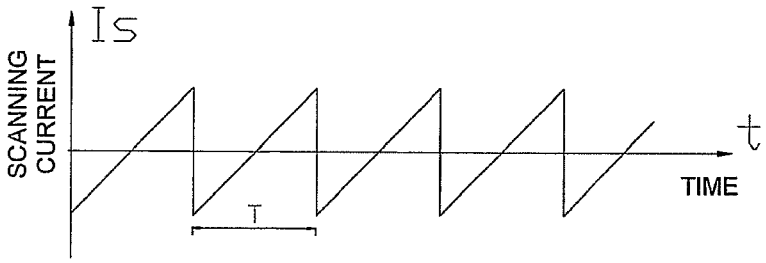
FIG. 3 is a schematic diagram depicting a sawtooth-shaped scanning current waveform used for scanning a current-limiting device in the apparatus according to an embodiment of the present disclosure.

According to an embodiment of the present disclosure, a sawtooth scanning current is usually used for scanning of the electron beams. The ideal scanning current may change smoothly and linearly from negative to positive, change instantaneously to the negative maximal when reaching the positive maximal, and then repeat such period change. The ideal scanning current may generate magnetic field of a waveform similar to the current waveform. FIG. 3 shows the waveform of the sawtooth scanning current.

According to an embodiment of the present disclosure, the vacuum box 3 is a hermetically sealed cavity case inside which is a high-vacuum. The case is primarily made of insulating material, such as glass or ceramic. The upper side of the vacuum box 3 has an open interface to input the electron beam currents. The current-limiting device 4 is disposed at the central part of the vacuum box 3, and the anode target 5 is disposed on the lower side of the vacuum box 3. The cavity between the upper side and the center part is big enough for movement of the scanned and deflected electron beams, and will not block any of the deflected electron beam currents in the triangular area as shown in the figure. The cavity between the center part and the lower side is big enough for parallel movement of the electron beam currents, and will not block any of the electron beam currents in the rectangular area between the current-limiting device 4 and the anode target 5. The high vacuum inside the vacuum box 3 is obtained by baking and discharging within a high-temperature discharge oven, and the vacuum degree is usually better than $10^{-5}$ Pa.

According to an embodiment of the present disclosure, the case of the vacuum box 3 may be made of metal material, such as stainless steel. If the case of the vacuum box 3 is made of metal material, the case should be kept at a distance from the inside current-limiting device 4 and anode target 5, so that the vacuum box 3, the current-limiting device 4 and the anode target 5 are electrically insulated from each other, while no impact is imposed on the distribution of electric field between the current-limiting device 4 and the anode target 5.

Figure 4:
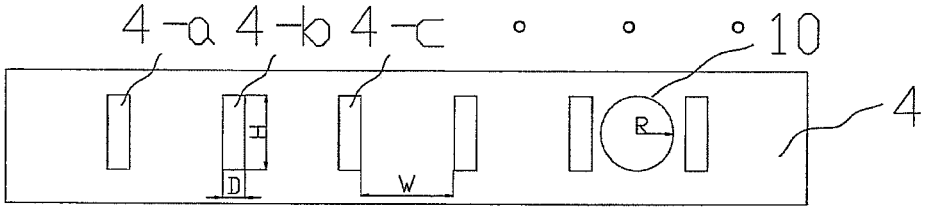
FIG. 4 is a schematic diagram showing a plan view of the current-limiting device according to an embodiment of the present disclosure.

According to an embodiment of the present disclosure and referring to FIG. 4, the current-limiting device 4 includes a strip-shaped metal plate having an array of holes therein. A plurality of holes 4-*a*, 4-*b*, 4-*c*, . . . , arranged in an array are provided on the current-limiting device 4. There are at least two holes. The holes are configured to allow part of the electron beam currents to pass through. It is recommended that each hole is formed in a rectangular shape, and the holes are uniform in size and arranged in a line. The width D of each hole is in the range of 0.3 mm to 3 mm, desirably 0.5 mm to 1 mm, so that the electron beam currents passing through the holes have small beam spot and certain beam intensity. The length H of each hole is in the range of 2 mm to 10 mm, desirably 4 mm, so that the intensity of the electron beam currents passing through the holes can be increased without affecting x-ray target points. The interval W between two adjacent holes is required to be not less than 2R, R being the radius of the beam spot of the electron beam currents projected onto the current-limiting device 4, so that in operation, the beam spot of the electron beam currents projected onto the current-limiting device 4 moves around with the magnitude of the magnetic field B, and the beam spot can cover only one of the holes. At a particular moment, there is only one hole on the current-limiting device 4 which the electron beam currents can pass through. In other words, the electron beam currents are focused at the position of one hole, pass through the one hole into the high-voltage electric field between the current-limiting device 4 and the anode target 5 to be accelerated, and finally bombard the anode target 5 to form one x-ray target point. As time elapses, the beam spot moves on the current-limiting device 4, and thus covers a next hole through which the electron beam currents will pass, and correspondingly forms the next x-ray target point on the anode target 5.

Figure 5:
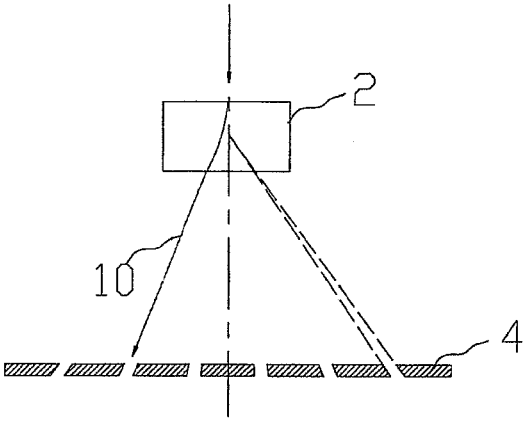
FIG. 5 is a schematic diagram showing a sectional view of the current-limiting device of FIG. 4 according to an embodiment of the present disclosure.

FIG. 5 shows a schematic diagram of the sectional view of the current-limiting device. The plate of the current-limiting device 4 has a thickness. The extended lines along the sectional surfaces of the respective holes in the deflection direction of the electron beam currents intersect at the center of the magnetic field B, so that each of the holes allows the same amount of electron beam currents to pass through.

Figure 6:
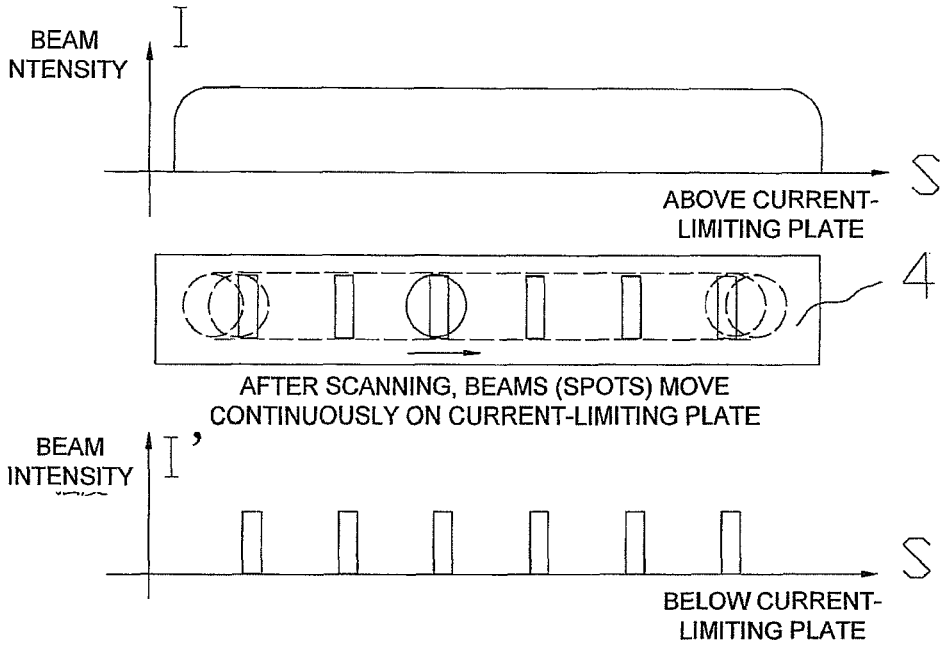
FIG. 6 shows spatial distribution and intensity variation of electron beam currents when they pass through the current-limiting device according to an embodiment of the present disclosure.

FIG. 6 shows changes in the electron beam currents passing through the current-limiting device 4. Spot-type electron beam currents continuously generated by the electron gun 1 enter the vacuum box. When acted upon by the scanning device 2, the travel direction of the electron beam currents is deflected periodically. During one cycle, the beam spots of the electron beam currents superpose to obtain an electron beam intensity which has a uniform distribution from left to right side of the current-limiting device 4 as shown in the upper side of FIG. 6. Due to the array of holes of the current-limiting device 4, the electron beam intensity has a distribution of periodic histogram beneath the current-limiting device 4 as shown in the lower side of FIG. 6. The electron beams are sequentially generated from left to right one by one, and have the same array-type distribution as the holes on the current-limiting plate. For each of the positions from left to right, only one electron beam is generated at a moment within one cycle.

In an embodiment, the current-limiting device 4 has the same voltage as the anode of the electron gun 1, so that when the electron beam currents 10 generated by the electron gun 1 travel to the current-limiting device 4, the travel path is not affected by any other factor except the deflection caused by the scanning magnetic field. According to another embodiment, the current-limiting device 4 may have a voltage different from the anode of the electron gun 1. This depends on different application scenarios and requirements.

According to an embodiment of the present disclosure, the anode target 5 is made of a metal strip, and provided at the lower side of the vacuum box 3 as being parallel to the current-limiting device 4 in the length direction while at a small angle with the current-limiting device 4 in the width direction. The anode target 5 is exactly parallel to the current-limiting device 4 in the length direction (as shown in FIG. 1). A positive high voltage is applied to the anode target 5, and a parallel high-voltage electric field is thus formed between the anode target 5 and the current-limiting device 4. The electron beam currents passing through the current-limiting device 4 are accelerated by the high-voltage electric field, travel along the direction of the electric field, and finally bombard the anode target 5 to generate x-rays 11.

Figure 7:
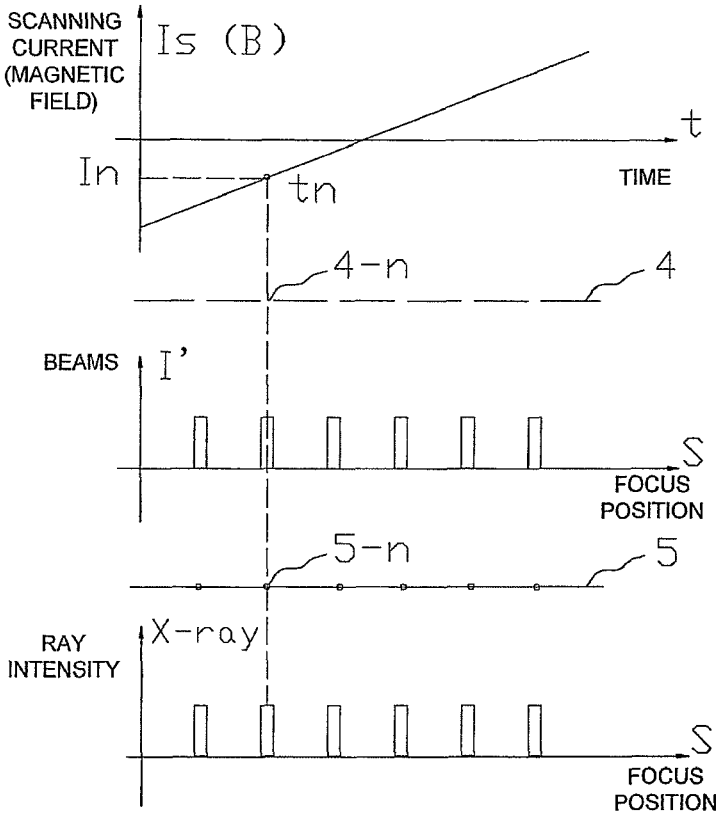
FIG. 7 is a schematic diagram depicting relationship between scanning current, electron beam current, and position of x-ray focus with respect to the current-limiting device and the anode within a cycle.

FIG. 7 is a schematic diagram depicting a relationship between scanning current, electron beam current, and position of x-ray focus spot with respect to the current-limiting device and the anode within a cycle. The electron beam currents that can pass through the current-limiting device 4 are sequentially distributed in an array, and thus the x-rays and x-ray focus spots generated by the electron beam currents 10 bombarding the anode target 5 are also distributed in an array at the anode target, as shown in FIG. 7. During one cycle, the scanning current Is(B) changes slowly and linearly from the negative maximal to the positive maximal, and generates a magnetic field that changes in a similar manner to the scanning current Is(B). Different scanning currents Is(B) cause the electron beam currents to project to different positions on the current-limiting plate. At the majority of moments in a cycle, the electron beam currents 10 are blocked by the current-limiting device 4, while at a few moments the electron beam currents can exactly pass through the holes on the current-limiting device 4. As an example, at the moment tn, the scanning current is In, causing the electron beam currents 10 to project to the hole 4-*n* on the current-limiting device, pass through the hole and become I'. The electron beam currents are then accelerated by the parallel high-voltage electric field between the current-limiting device 4 and the anode target 5, obtain high energy, and finally bombard the anode target 5 at a position 5-*n* corresponding to the hole 4-*n* on the current-limiting device, thereby generating x-rays. The position 5-*n* becomes a focus spot of x-rays. The holes on the current-limiting device are distributed in an array, and thus x-rays generated at the anode target 5 have focus spots of an arrayed distribution.

Figure 8:
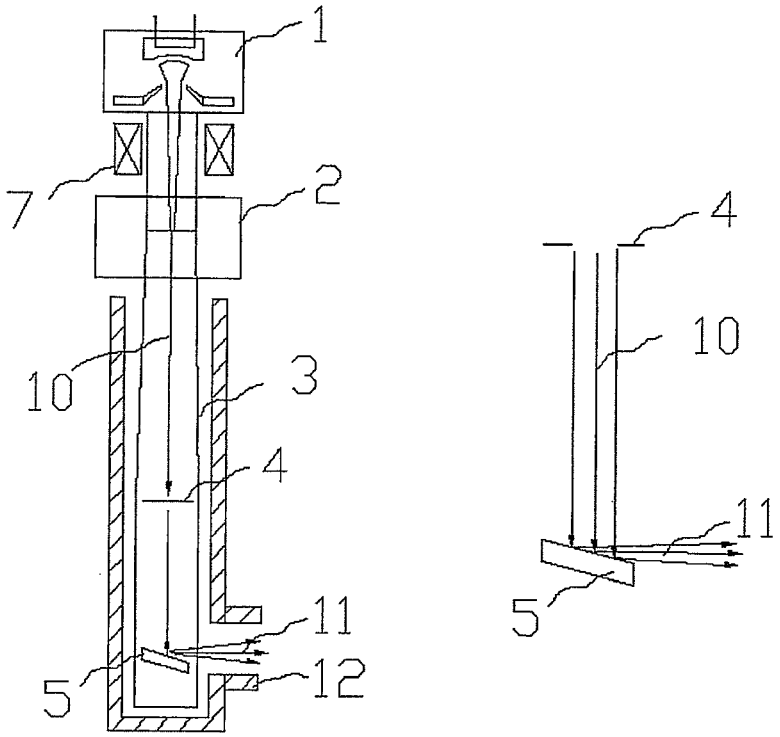
FIG. 8 includes schematic diagrams showing sectional and partial views of an apparatus to generate distributed x-rays according to another embodiment of the present disclosure.

FIG. 8 shows sectional views of an apparatus to generate distributed x-rays. According to another embodiment of the present disclosure, the anode target 5 is disposed along the direction of the short side at a small angle with the current-limiting device 4 as shown in FIG. 8. The high voltage at the anode target 5 is usually tens of kVs to hundreds of kVs. The x-rays generated at the anode target have the highest intensity in a direction which is at a 90 degree angle with the incident electron beams. The rays along the direction are usable. The anode target 5 is tilted at a small angle of generally several to tens degrees. This facilitates emission of the x-rays. On the other hand, even when a wide electron beam current projects onto the anode target, the focus spot of the generated x-rays is small in size when viewed from the emission direction of the x-rays, that is, reducing the focus spot size. According to the embodiment of the present disclosure, it is recommended that the anode target 5 may be made of high-temperature resistant metal, such as tungsten. According to other embodiments of the present disclosure, the anode target 5 may be made of some other material, such as molybdenum.

According to an embodiment of the present disclosure, the power and control system 6 provides power supply and operation control necessary for the respective key components of the distributed x-ray source apparatus. As shown in FIG. 1, the power and control system 6 includes an electron gun power supply 61, focusing power supply 62, scanning power supply 63, vacuum power supply 64, and anode power supply 65.

In an example, the electron gun power supply 61 provides filament current and negative high voltage to the electron gun 1. The scanning power supply 63 provides scanning current to the scanning device, so that the electron beam currents generated by the electron gun 1 scan the current-limiting device 4 in accordance with the scanning waveform shown in FIG. 3.

The focusing power supply 62 provide power for the focusing device 7, so that the electron beam currents generated by the electron gun 1 have better quality upon entry to the vacuum box. For example, the electron beam currents have small beam spot, larger current intensity, and higher consistency in traveling movement.

The vacuum power supply 64 is coupled with the vacuum device 8 to control and supply power to the latter. The vacuum device 8 is provided on the vacuum box, and operates with the vacuum power supply to maintain high vacuum inside the vacuum box. The anode power supply 65 provides a positive high voltage to the anode target 5 and logic control over the anode operation under the high voltage.

According to an embodiment of the present disclosure, the distributed x-ray source apparatus may further include a focusing device 7 consisting of a beam current conduit and a focusing coil pack around the conduit. The beam current conduit is disposed between the electron gun 1 and the vacuum box 3. With the focusing power supply 63, the focusing device 7 may operate to make the electron beam currents generated by the electron gun 1 have better quality when they enter the vacuum box. For example, the electron beam currents may have smaller beam spot, greater current intensity and higher consistency in traveling movement.

According to an embodiment of the present disclosure, the distributed x-ray source apparatus may further include a vacuum device 8 disposed on the vacuum box. With the vacuum power supply 64, the vacuum device 8 may operate to maintain high vacuum within the vacuum box. Normally, when the distributed x-ray source apparatus operates, electron beams bombard the current-limiting device 4 and the anode target 5 both of which will generate heat and discharge a small amount of gas. The gas may be quickly drained by the vacuum device 8 to maintain high vacuum within the vacuum box. The vacuum device 8 may include a vacuum ion pump.

According to an embodiment of the present disclosure, the distributed x-ray source apparatus may further include a plug-pull high-voltage connection device 9 disposed at the lower side of the vacuum box. The connection device 9 is coupled with the anode target 5 in the vacuum box, and extends outside the vacuum box to form a sealed structure together with the vacuum box. The plug-pull high-voltage connection device 9 is configured to directly connect a high-voltage power supply with the anode target 5.

According to an embodiment of the present disclosure, the distributed x-ray source apparatus may further include a shielding and collimation device 12 as shown in FIG. 8. The shielding and collimation device 12 is disposed outside the vacuum box, and configured to screen out unwanted x-rays. The shielding and collimation device 12 has a strip-shaped opening with respect to the anode at the position where the usable x-rays exit. The opening has certain length and width designed in the direction of x-ray emission so as to constrain the x-rays within a desired application range. It is recommended that the shielding and collimation device 12 is made of leaded material. According to an embodiment of the present disclosure, the power and control system 6 of the distributed x-ray source apparatus may further include power supplies for the focusing device and the vacuum device.

As shown in FIGS. 1 and 8, a distributed x-ray source apparatus may include an electron gun 1, a scanning device 2, a vacuum box 3, a current-limiting device 4, an anode target 5, a focusing device 7, a vacuum device 8, a plug-pull high-voltage connection device 9, a shielding and collimation device 12, and a power and control system 6.

According to some embodiments, the electron gun 1 includes a hot cathode electron gun. The output of the electron gun 1 is coupled with one end of the vacuum conduit of the focusing device 7. The other end of the vacuum conduit is coupled to the upper side of the vacuum box 3. The focusing coil pack is provided on the outer side of the vacuum conduit. The scanning device 2 is disposed externally to the upper side of the vacuum conduit. The current-limiting device 4 is disposed at the central part of the vacuum box 3, and the vacuum device 8 is positioned to one side of the vacuum box 3 at the level of the central part. The strip-shaped anode target 5 and the plug-pull high-voltage connection device 9 coupled with the anode target 5 are disposed at the lower side of the vacuum box 3. The anode target 5 and the current-limiting device 4 are parallel to each other and have the substantially same length. The power and control system 6 includes a plurality of modules including an electron gun power supply 61, a focusing power supply 62, a scanning power supply 63, a vacuum power supply 64, an anode power supply 65 and the like, which are coupled with components including the electron gun 1, the focusing device 7, the scanning device 2, the vacuum device 8, the anode target 5 and the like, via power cable and control cable.

In operation, the electron gun power supply 61, the focusing power supply 62, the scanning power supply 63, the vacuum power supply 64, and the anode high-voltage power supply 65 start to operate according to set programs, respectively, under the control of the power and control system 6. The electron gun power supply 61 provides power to the filament 1 of the electron gun, which in turn heats the cathode up to a very high temperature to generate a large number of thermo-emission electrons. Meanwhile, the electron gun power supply 61 provides a negative high voltage of 10 kV to the cathode of the electron gun, so that a small high voltage electric field for acceleration is formed between the cathode and the anode of the electron gun. The thermo-emission electrons are accelerated by the electric field to travel toward the anode, thereby forming electron beam currents 10.

In the process of traveling toward the anode, the electron beam currents are focused by the focusing electrode of the electron gun to form beam currents of small beam spot and pass through the central hole of the anode, and then become electron beam currents having initial movement energy (10 kV) and speed. The electron beam currents proceed into the vacuum conduit, and are focused by the focusing device 7 so that the width/diameter of the beam spot is further reduced, thereby obtaining small-spot, high-intensity electron beam currents. Such electron beam currents further proceed into the vacuum box 3 and are subjected to the scanning device 2 at the top of the vacuum so that the movement direction is periodically deflected. When proceeding further to the current-limiting device 4, the majority of the deflected electron beam currents are blocked and absorbed by the current-limiting device 4. Part of the electron beam currents appropriately deflected can pass through the holes on the current-limiting device 4, and enter the high-voltage electric field between the current-limiting device 4 and the anode target 5. Acted upon by the high-voltage electric field, the electron beam currents move along the direction of the electric field (i.e., moving perpendicularly from the current-limiting device 4 to the anode), obtain high energy, and bombard the anode target 5, thereby generating x-rays 11.

During one scanning cycle, the electron beam currents pass sequentially through the array of holes on the current-limiting device 4, and thus bombard sequentially the anode target at corresponding positions on the anode target, generating sequentially an array of x-rays and x-ray target points. In this way, a distributed x-ray source is realized. Gas released when the anode target is bombarded by the electron beam currents are drained by the vacuum device 8 in real time, and thus high vacuum is maintained within the vacuum box. This is advantageous for a long-term stable operation.

The shielding and collimation device 12 screens out x-rays in unwanted directions, passes x-rays in the desired directions, and restricts x-rays to a predetermined range.

In addition to controlling the respective power supplies to drive, in accordance with set programs, the respective components to coordinately operate, the power and control system 6 may receive external commands via communication interface and man-machine interface, modify and set important system parameters, update programs, and performs automatic control and adjustment.

According to an embodiment of the present disclosure, x-rays are generated in an x-ray source apparatus, and the x-rays have focus spot positions which are periodically changed in certain order. Further, using a hot-cathode source has advantages of high emission current and long life time compared with other designs. Further, scanning directly with electron beam currents at low energy of initial movement has advantages of easier control operation and higher scanning speed. Further, positions of beam currents and focus spots can be changed by means of electromagnetic scanning in a fast and efficient manner. The design of conducting current limitation before high-energy acceleration can obtain beam currents distribution in an array, preserve electric power and effectively prevent the current-limiting device from generating heat. Further, the design of large strip-shaped anode can effectively mitigate overheating of the anode, and facilitate improvement of source power. Further, compared with other distributed x-ray source apparatuses, the above embodiments have advantages of high current, small target points, uniform distribution of positions of the target points, good repetitiveness, high output power, simple process and low cost. Further, the apparatus to generate distributed x-rays according to the embodiments of the present disclosure can be applied in CT apparatuses to obtain multiple view angles without movement of the source, and thus omit the movement along the slip ring. This is advantageous for structure simplification, and improvement of system stability, reliability and inspection efficiency.

Various embodiments of the apparatus and method to generate distributed x-rays have been described in detail with reference to block diagrams, flowcharts, and/or examples. In the case that such block diagrams, flowcharts, and/or examples include one or more functions and/or operations, those skilled in the art will appreciate that each function and/or operation in the block diagrams, flowcharts, and/or examples can be implemented, individually and/or collectively, as various hardware, software, firmware or substantially any combination thereof. In an embodiment, several parts of the subject matters illustrated in the embodiments, such as control process, may be implemented with application specific integrated circuit (ASIC), field programmable gate array (FPGA), digital signal processor (DSP) or any other integrated format. Those skilled in the art will appreciate that some aspects of the embodiments disclosed here, in part or as a whole, may be equivalently implemented in integrated circuit, as one or more computer programs running on one or more computers (e.g., one or more programs running on one or more computer systems), as one or more programs running on one or more processors (e.g., one or more programs running on one or more microprocessors), in firmware, or in substantially any combination thereof. Those skilled in the art are able to design circuits and/or write software and/or firm codes according to the present disclosure. Further, those skilled in the art will appreciate that the control process in the present disclosure can be distributed as various forms of program products. Whatever specific type of signal bearing medium is used to fulfill the distribution, the example embodiments of the subject matters of the present disclosure are applicable. Examples of the signal bearing medium include but not limited to recordable medium, such as floppy disk, hard disk drive, compact disk (CD), digital versatile disk (DVD), digital tape, computer memory, and transmission-type medium, such as digital and/or analog communication medium (e.g., optical fiber cable, waveguide, wired and wireless communication link).

The present disclosure has been described with reference to several exemplary embodiments. It will be appreciated that the terms used here are for illustration, are exemplary other than limiting. The present disclosure can be practiced in various forms within the spirit or subject matter of the present disclosure. It will be appreciated that the foregoing embodiments are not limited to any of the above detailed description, and should be construed in a broad sense within the spirit and scope defined by the appended claims. All changes and variations falling into the scope of the claims or their equivalents should be encompassed by the appended claims.

What is claimed is:

1. An apparatus to generate distributed x-rays, the apparatus comprising:

an electron gun configured to generate electron beam currents;

a scanning device configured to generate a scanning magnetic field to deflect the electron beam currents;

a current-limiting device having a plurality of regularly-arranged holes, wherein lines extending along sectional surfaces of respective holes of the current-limiting device and in the deflection direction of the electron beam currents, intersect at a central portion of the scanning magnetic field;

a control system configured to control the scanning device to scan the electron beam currents relative to the current-limiting device such that a central portion of the electron beam currents becomes incident on an opaque portion of the current-limiting device between at least two of the holes and such that, when the electron beam currents scan through the holes of the current-limiting device, pulsed electron beams corresponding to positions of the holes in the scanning order are outputted in an array beneath the current-limiting device; and an anode target arranged downstream of the current-limiting device, wherein an electric field is formed between the current-limiting device and the anode target to accelerate the array of the pulsed electron beams, and wherein the accelerated electron beams bombard the anode target to generate x-rays.

2. The apparatus of claim 1, further comprising a vacuum box provided downstream of the electron gun, coupled with the electron gun, and enclosing the current-limiting device and the anode target, the vacuum box configured to provide a high vacuum environment for generation and movement of electron beams.

3. The apparatus of claim 2, further comprising a power and control device configured to provide power supply and operation control to the electron gun, the scanning device and the anode target.

4. The apparatus of claim 3, wherein the current-limiting device comprises a strip-shaped metal plate having a plurality of holes.

5. The apparatus of claim 3, further comprising a plug-pull high-voltage connection device at a lower side of the vacuum box, the plug-pull high-voltage connection device coupled with the anode target inside the vacuum box, extending outside the vacuum box, and configured to directly connect the power and control device with the anode target.

6. The apparatus of claim 2, further comprising a focusing device at a position where the electron gun is coupled with the vacuum box, the focusing device configured to focus the electron beam currents and reduce a beam spot of the electron beam currents.

7. The apparatus of claim 2, further comprising a vacuum device on the vacuum box, the vacuum device configured to maintain high vacuum inside the vacuum box.

8. The apparatus of claim 7, wherein the vacuum device comprises a vacuum ion pump.

9. The apparatus of claim 2, further comprising a shielding and collimation device outside the vacuum box, the shielding and collimation device comprising a strip-shaped collimation opening corresponding to the anode target.

10. The apparatus of claim 9, wherein the shielding and collimation device is made of leaded material.

11. The apparatus of claim 1, wherein the anode target comprises a strip-shaped metal plate having a length substantially identical to that of the current-limiting device.

12. The apparatus of claim 11, wherein the anode target is made of tungstenic material.

13. The apparatus of claim 1, wherein the anode target is parallel to the current-limiting device in a length direction, and at a small angle with respect to the current-limiting device in a width direction.

14. A method of generating distributed x-rays, the method comprising:

controlling an electron gun to generate electron beam currents;

controlling a scanning device to generate a scanning magnetic field for deflecting the electron beam currents relative to a current-limiting device such that a central portion of the electron beam currents becomes incident on an opaque portion of the current-limiting device between at least two of a plurality of holes regularly arranged on the current-limiting device and such that the electron beam currents scan through the holes to output pulsed electron beams distributed in an array, wherein lines extending along sectional surfaces of respective holes of the current-limiting device and in the deflection direction of the electron beam currents, intersect at a central portion of the scanning magnetic field; and generating an electric field between the current-limiting device and an anode target to accelerate the pulsed electron beams distributed in the array, the accelerated electron beams bombarding the anode target to generate x-rays.

15. The method of claim 14, wherein the current-limiting device comprises a strip-shaped metal plate having a plurality of holes.

16. The method of claim 14, wherein the anode target comprises a strip-shaped metal plate having a length substantially identical to that of the current-limiting device.

17. The method of claim 14, further comprising providing a high vacuum environment for generation and movement of electron beams in a vacuum box provided downstream of the electron gun, the vacuum box coupled with the electron gun and enclosing the current-limiting device and the anode target.

18. The method of claim 14, wherein the anode target is parallel to the current-limiting device in a length direction, and at a small angle with respect to the current-limiting device in a width direction.

19. The method of claim 14, further comprising using a focusing device to focus the electron beam currents and reduce a beam spot of the electron beam currents.

20. The method of claim 14, further comprising using a shielding and collimation device to shield unwanted x-rays and to constrain the desired x-rays within a desired application range using a strip-shaped collimation opening corresponding to the anode target.

* * * * *